US011627784B2

(12) United States Patent
Tung et al.

(10) Patent No.: US 11,627,784 B2
(45) Date of Patent: Apr. 18, 2023

(54) FASTENER STRINGER, METHOD FOR MANUFACTURING SAME, AND SLIDE FASTENER

(71) Applicant: YKK Corporation, Tokyo (JP)

(72) Inventors: Yuchen Tung, Kurobe (JP); Kazuo Tamura, Kurobe (JP); Yoshinori Kojima, Kurobe (JP); Jiro Nozaki, Kurobe (JP)

(73) Assignee: YKK Corporation, Tokyo (JP)

( * ) Notice: Subject to any disclaimer, the term of this patent is extended or adjusted under 35 U.S.C. 154(b) by 10 days.

(21) Appl. No.: 17/613,356

(22) PCT Filed: Sep. 10, 2019

(86) PCT No.: PCT/JP2019/035588

§ 371 (c)(1),
(2) Date: Nov. 22, 2021

(87) PCT Pub. No.: WO2021/048930

PCT Pub. Date: Mar. 18, 2021

(65) Prior Publication Data

US 2022/0225740 A1 Jul. 21, 2022

(51) Int. Cl.
*A44B 19/24* (2006.01)
*A44B 19/38* (2006.01)

(52) U.S. Cl.
CPC ..... *A44B 19/24* (2013.01); *A44B 19/38* (2013.01); *A44D 2203/00* (2013.01)

(58) Field of Classification Search
CPC ..... A44B 19/24; A44B 19/38; A44B 19/36; A44D 2203/00
See application file for complete search history.

(56) References Cited

U.S. PATENT DOCUMENTS 7,320,158 B2 * 1/2008 Deto ..... A41F 1/002 24/433
11,425,972 B2 * 8/2022 Ekko ..... A44B 19/384
11,432,622 B2 * 9/2022 Owings ..... A44B 19/388
2005/0050699 A1 3/2005 Yoneoka
(Continued)

FOREIGN PATENT DOCUMENTS

CN 204032535 U 12/2014
JP 2004-248809 A 9/2004
(Continued)

OTHER PUBLICATIONS

International Preliminary Report on Patentability, PCT Patent Application No. PCT/JP2019/035588, dated Mar. 24, 2022, 8 pages.
(Continued)

*Primary Examiner* — Robert Sandy
(74) *Attorney, Agent, or Firm* — Kilpatrick Townsend & Stockton LLP

(57) ABSTRACT

Fastener stringer includes a fastener tape provided with a fastener element; and a stop part arranged at an end of the fastener tape. The stop part includes: a magnetic body; an encapsulating member encapsulating the magnetic body; and an injection-molded portion that at least partially covers or surrounds the encapsulating member encapsulating the magnetic body. At least the encapsulating member hinders heat from being transferred to the magnetic body while the injection-molded portion is formed.

17 Claims, 12 Drawing Sheets

(56) References Cited

U.S. PATENT DOCUMENTS

| | | | |
|---|---|---|---|
| 2013/0061436 | A1 | 3/2013 | Peters et al. |
| 2018/0000203 | A1 | 1/2018 | Jin |
| 2020/0015554 | A1 | 1/2020 | Takazawa et al. |
| 2021/0007446 | A1 | 1/2021 | Ekko et al. |

FOREIGN PATENT DOCUMENTS

| | | | |
|---|---|---|---|
| JP | 2007-229411 | A | 9/2007 |
| JP | 3170902 | U | 10/2011 |
| JP | 2014-526316 | A | 10/2014 |
| JP | 2018-507719 | A | 3/2018 |
| WO | 2018/061208 | A1 | 4/2018 |
| WO | 2019/175944 | A1 | 9/2019 |

OTHER PUBLICATIONS

International Search Report, PCT Application No. PCT/JP2019/035588, dated Dec. 3, 2019.

* cited by examiner

FASTENER STRINGER, METHOD FOR MANUFACTURING SAME, AND SLIDE FASTENER

TECHNICAL FIELD

The present disclosure is related to fastener stringers and methods for producing the same, and slide fasteners.

BACKGROUND ART

Stop members with a magnetic body have been known as disclosed in Patent literatures 1 and 2. In Patent literature 1, as illustrated in its FIG. 5, a magnetic body is pressed into a recess of a slide-contacting plate. In Patent literature 2, a magnetic body is placed in a recess of a base and confined therein by a cover as illustrated in its FIG. 2.

CITATION LIST

Patent Literature

[PTL 1] Japanese Patent Application Laid-open No. 2004-248809

[PTL 2] Chinese Examined Utility-model application Laid-open No. 204032535

SUMMARY

Technical Problem

The present inventors have newly recognized the importance of more reliably avoiding separation of magnetic body off/from stop part through different approaches over prior ones.

Solution to Problem

Fastener stringer according to an aspect of the present disclosure includes a fastener tape provided with a fastener element, and a stop part arranged at an end of the fastener tape. The stop part includes: a magnetic body; an encapsulating member encapsulating the magnetic body; and an injection-molded portion that at least partially covers or surrounds the encapsulating member encapsulating the magnetic body. At least the encapsulating member hinders heat from being transferred to the magnetic body while the injection-molded portion is formed.

In some embodiments, a heat-insulating layer is formed between the encapsulating member and the magnetic body. The encapsulating member may have an exposed surface that is exposed from the injection-molded portion. The injection-molded portion may be shaped to hinder the encapsulating member from being separated from the injection-molded portion. The injection-molded portion may have an outer peripheral portion arranged circumferentially around the encapsulating member and an undercut extending or protruding radially inward from the outer peripheral portion.

In some embodiments, the encapsulating member includes at least first and second members, a boundary between the first and second members being sealed by the injection-molded portion. One of the first and second members may be a cup-like portion having an inlet through which the magnetic body is received, and the other one of the first and second members may be a lid that closes the inlet of the cup-like portion. One of the first and second members may have an inlet through which the magnetic body is received and one or more protrusions arranged along a periphery of the inlet, and the other one of the first and second members may have one or more recesses mated with the one or more protrusions.

In some embodiments, the encapsulating member has (i) a truncated-cone-like portion having a side face partially covered by the injection-molded portion or (ii) a flat surface partially covered by the injection-molded portion. The injection-molded portion may include a base including the encapsulating member; and an extending portion extending from the base so as to have an insertion portion that is to be inserted into a slider. The base may have at least one sloped surface that approaches the encapsulating member as extending along a circumferential direction about an axis on which N-pole and S-pole of the magnetic body are aligned, and the sloped surface may be positioned over the encapsulating member at least partially.

In some embodiments, the encapsulating member includes a truncated-cone-like portion with its side face partially covered by the injection-molded portion, and the base has at least one sliding portion arranged radially outward of the truncated-cone-like portion with respect to an axis on which N-pole and S-pole of the magnetic body are aligned. The magnetic body may be a neodymium magnet.

Slide fastener according to an aspect of the present disclosure includes: first and second fastener stringers, the first fastener stringer including a first fastener tape provided with a first fastener element, and a first stop part provided at an end of the first fastener tape, and the second fastener stringer including a second fastener tape provided with a second fastener element, and a second stop part provided at an end of the second fastener tape and adapted to configure a stop together with the first stop part; and a slider adapted for engaging and disengaging the first and second fastener stringers. The first stop part includes a first magnetic body, a first encapsulating member encapsulating the first magnetic body, a first injection-molded portion that at least partially covers or surrounds the first encapsulating member encapsulating the first magnetic body, and at least one sloped surface that approaches the first encapsulating member as extending along a circumferential direction about an axis on which N-pole and S-pole of the first magnetic body are aligned. The second stop part includes a second magnetic body, a second encapsulating member encapsulating the second magnetic body, a second injection-molded portion that at least partially covers or surrounds the second encapsulating member encapsulating the second magnetic body, and at least one sliding portion that slides on the sloped surface in accordance with magnetic attraction effected between the first and second magnetic bodies.

In some embodiments, the first encapsulating member has a flat surface partially covered by the injection-molded portion, and the sloped surface is at least partially formed over the flat surface, the encapsulating member has a truncated-cone-like portion with its side face partially covered by the injection-molded portion, and the sliding portion is arranged radially outward of the truncated-cone-like portion with respect to an axis along which N-pole and S-pole of the second magnetic body are aligned. The first encapsulating member has a flat surface partially covered by the injection-molded portion, and the sloped surface is at least partially formed over the flat surface, the second encapsulating member has a truncated-cone-like portion with its side face partially covered by the injection-molded portion, and the sliding portion is arranged radially outward of the truncated-cone-like portion with respect to an axis along which N-pole and S-pole of the second magnetic body are aligned.

In some embodiments, at least one of the first and second encapsulating members includes a cup-like portion having an inlet through which the magnetic body is received, and a lid that closes the inlet of the cup-like portion.

Method of producing a fastener stringer according to an aspect of the present disclosure is a method of producing a fastener stringer that comprises a fastener tape provided with a fastener element, and a stop part arranged at an end of the fastener tape, the method comprising: encapsulating a magnetic body in an encapsulating member; and performing injection-molding in a condition where the encapsulating member, by which the magnetic body is encapsulated, and a portion of the fastener tape are arranged in a mold-cavity of a mold, wherein at least the encapsulating member hinders heat from being transferred to the magnetic body during the injection molding.

Advantageous Effects of Invention

According to an aspect of the present disclosure, it may be facilitated that separation of magnetic body off/from stop part may be more reliably avoided.

DESCRIPTION OF EMBODIMENTS

Hereinafter, various embodiments and features will be discussed with reference to FIGS. 1 to 20. Skilled person could combine respective embodiments and or respective features without requiring excess descriptions and could appreciate synergic effects of such combinations. Overlapping descriptions between embodiments would be basically omitted. Referenced drawings are prepared for a purpose of illustration of invention and are simplified for ease of preparation of drawings. Respective features would be appreciated as generic features which are not only effective to fastener stringers and methods of producing the same disclosed in the present specification but also effective to other various fastener stringers and methods for producing the same not disclosed in the present specification.

Hereinafter, Front-rear direction would be understood based on the movement direction of slider in which frontward movement of slider closes a slide fastener and rearward movement of slider opens a slide fastener. Left-right direction and Up-down direction are orthogonal to the front-rear direction. Left-right direction is a parallel direction relative to a tape surface of fastener tape. Up-down direction is a vertical direction relative to a tape surface of fastener tape. Terms indicating these directions can be redefined in light of the following descriptions.

Slide fastener 1 has a pair of left and right fastener stringers 2*m* and 2*n*, and a slider 90 adapted for engaging and disengaging the pair of left and right fastener stringers 2*m* and 2*n*. The term "a pair of left and right fastener stringers" will be used in describing the present embodiments for consistency of description, but it may alternatively be referred to as first and second fastener stringers. This holds true for other parts such as fastener elements, fastener tapes, and stop parts such that "first and second" may be referred to in lieu of "left and right".

The right-side fastener stringer 2*m* has a right-side fastener tape 4*m* provided with a right-side fastener element(s) 3*m*, and a right-side stop part 5*m* arranged at an end of the right-side fastener tape 4*m*. The left-side fastener stringer 2*n* has a left-side fastener tape 4*n* provided with a left-side fastener element(s) 3*n*, and a left-side stop part 5*n* arranged at an end of the left-side fastener tape 4*n*. The right and left stop parts 5*m* and 5*n* configure a separable stop. The fastener element should not be limited to the illustrated resin-made elements. The fastener element may be metal-made elements attached to a fastener tape through swaging or a coil element sewn onto or into the fastener tape. Structure of stop part may be modified in accordance with a type of fastener element. Fastener tape may be a woven web or knit web or combination thereof.

Figure 5:
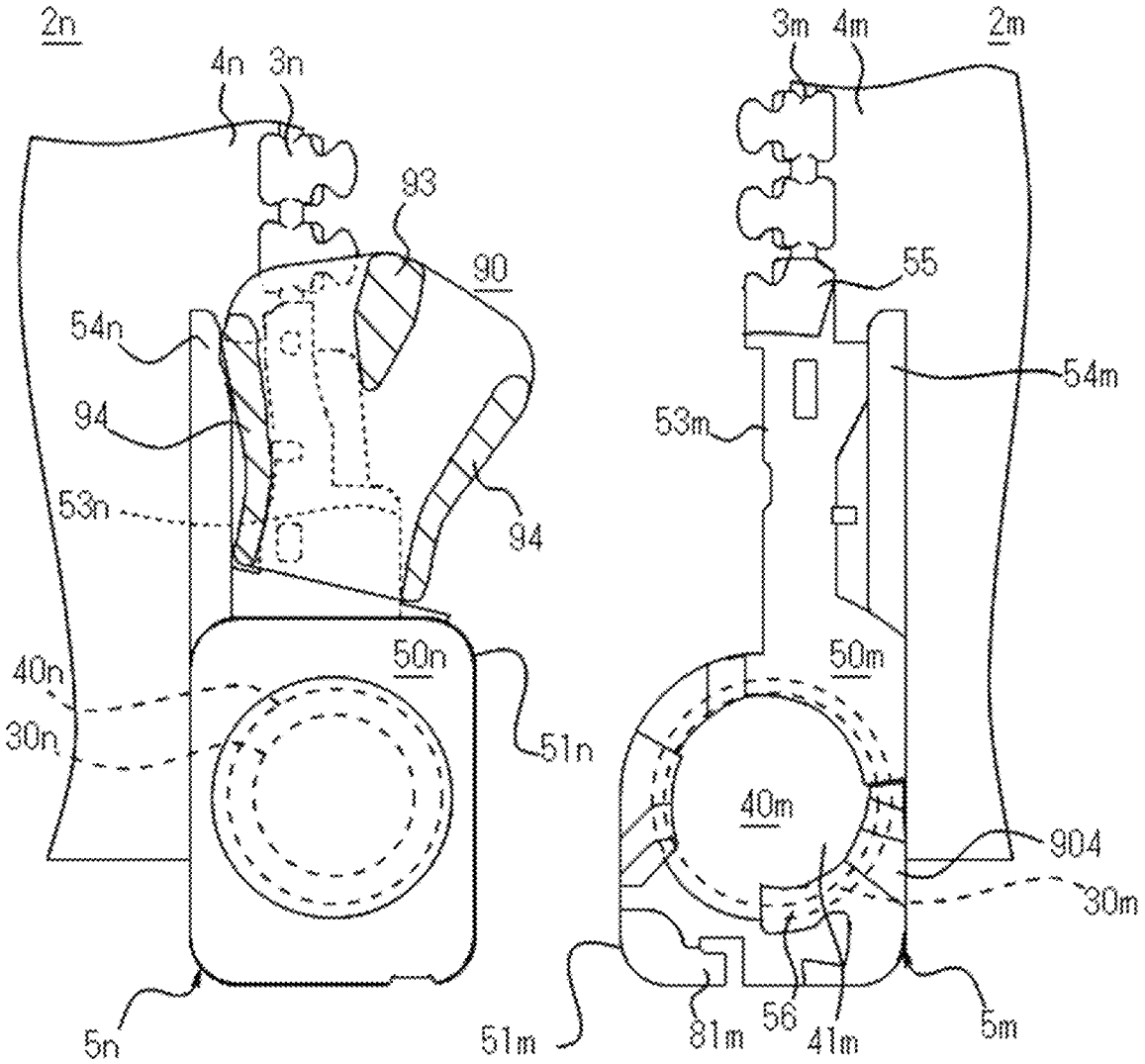
FIG. 5 is a schematic top-side elevation of rear end of slide fastener in separated condition of an aspect of the present disclosure. Slider is held by a left-side stop part.
Figure 7:
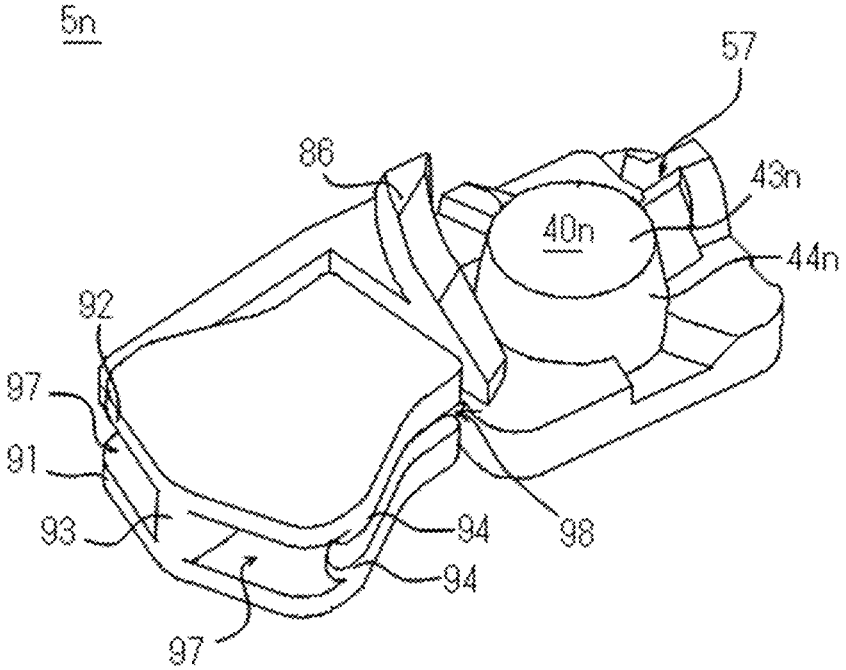
FIG. 7 is a schematic perspective view of a left-side stop part of an aspect of the present disclosure. Slider is held by the left-side stop part.

As would be understood from FIGS. 5 and 7, the left-side fastener elements 3*n* have been inserted through the slider 90, and the left-side stop part 5*n* prevents the slider 90 from being separated off/from the left-side fastener element 3*n*. Embodiments are envisaged where the right-side fastener elements 3*m* are inserted through the slider 90, and the right-side stop part 5*m* prevents the removal of the slider 90. The slider 90 has a top wing 91, a bottom wing 92, a coupling pillar 93 by which the top and bottom wings 91 and 92 are coupled, and flanges 94 situated at the left and right edges of the top and bottom wings 91 and 92. The slider 90 has a pair of left and right front mouths 97, arranged at the left and right sides of the coupling pillar 93, a rear mouth 98 and in turn, a Y-shaped element passage. The fastener tape is inserted into a slit between the flanges 94 of the top and bottom wings 91 and 92. The slider 90 may be formed from resin or metal or other material.

Figure 1:
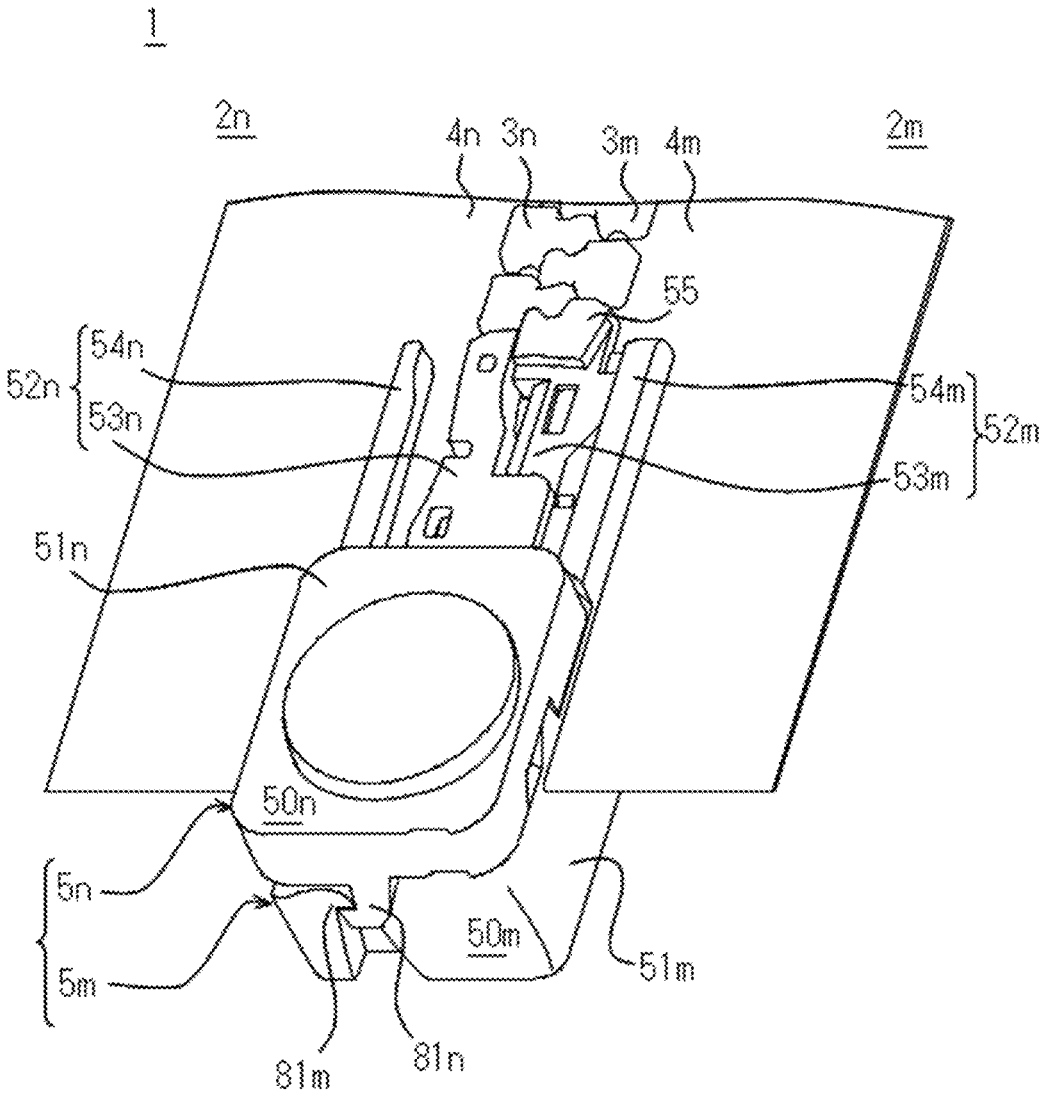
FIG. 1 is a schematic perspective view of a rear end of closed slide fastener of an aspect of the present disclosure. Illustration of slider is omitted as being located frontward away from the rear end of slide fastener.
Figure 2:
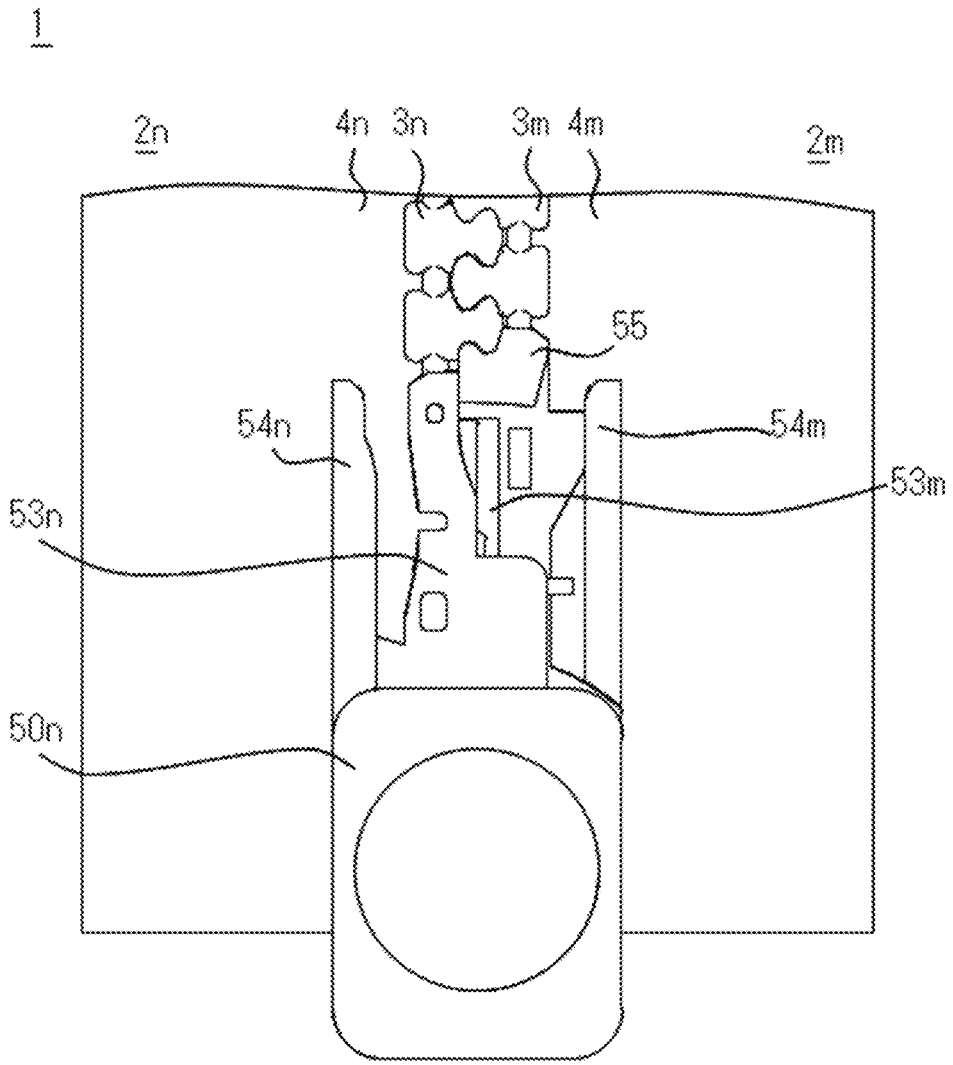
FIG. 2 is a schematic top-side elevation of a rear end of closed slide fastener of an aspect of the present disclosure.
Figure 3:
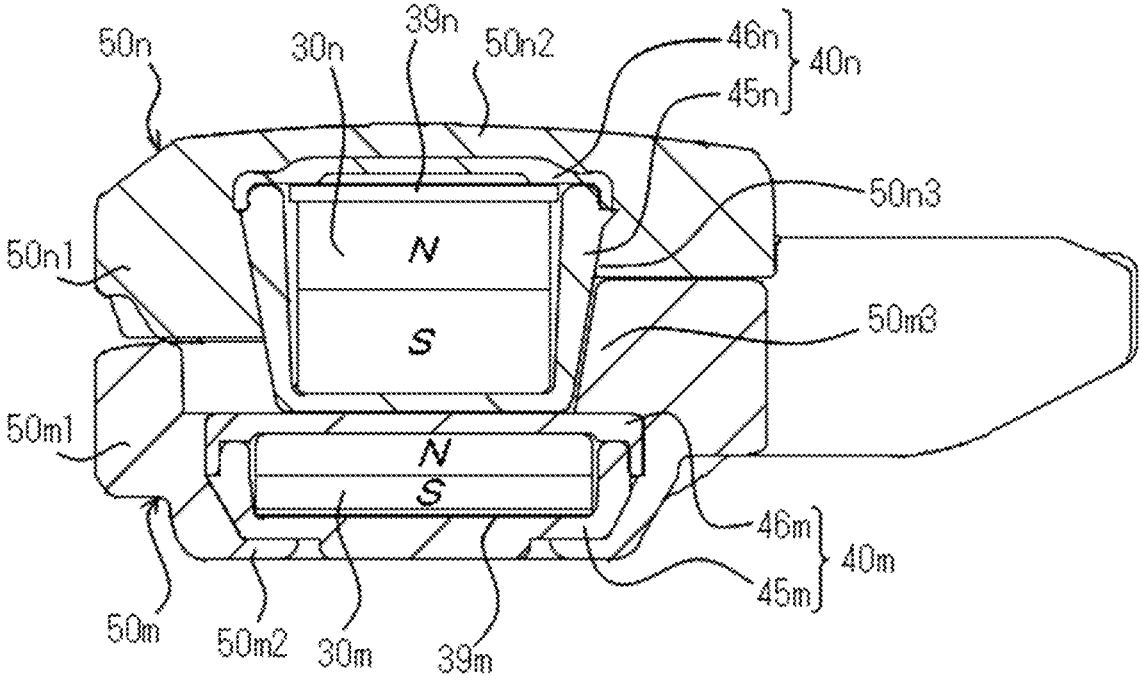
FIG. 3 is a schematic cross-sectional view of a stop of an aspect of the present disclosure, illustrating that each one of stop parts stacked in up-down direction has a magnetic body, an encapsulating member, and an injection-molded portion.

As illustrated in FIG. 3, the right-side stop part 5*m* includes a magnetic body 30*m*, an encapsulating member 40*m* encapsulating the magnetic body 30*m*, and an injection-molded portion 50*m* that at least partially covers or surrounds the encapsulating member 40*m* encapsulating the magnetic body 30*m*. Similarly, the left-side stop part 5*n* includes a magnetic body 30*n*, an encapsulating member 40*n* encapsulating the magnetic body 30*n*, and an injection-molded portion 50*n* that at least partially covers or surrounds the encapsulating member 40*n* encapsulating the magnetic body 30*n*.

The magnetic body may be, for example, a permanent magnet (e.g. rare-earth magnet such as neodymium magnet) or a metal attractable to a permanent magnet, or the like. In some cases, the magnetic body may be coated (e.g. nickel-plated, chrome-plated, epoxy-coated, nylon-coated and the like) for a purpose of avoiding or suppressing corrosion or demagnetization. If required, yokes 39*m* and 39*n* may be encapsulated in the encapsulating members 40*m* and 40*n*. The yoke may form a magnetic circuitry with the permanent magnet, suppressing the wasteful leakage of magnetic flux from the permanent magnet. The yoke 39*m*, 39*n* may be arranged farther from the opposed surfaces of the encapsulating members 40*m* and 40*n* than the magnetic body 30*m*, 30*n*.

The encapsulating member is configured to encapsulate the magnetic body, and hinders the injection-molded portion from directly touching the magnetic body. The encapsulating member may be formed of magnetic permeable material. Typically, the encapsulating member is made of resin and produced through injection-molding. In some cases, a heat-insulating layer is formed between the encapsulating member and the magnetic body. The heat-insulating layer may typically be an air-layer but should not be limited to this. Fluid with lower thermal conductivity (powder or liquid or combination thereof) may be injected into an interspace between the encapsulating member and the magnetic body.

The encapsulating member may be configured from two or more parts which can be coupled together. In the illustrated embodiment, the encapsulating member has a cup-like portion 45 as a first member and a lid 46 as a second member. The cup-like portion 45 has an inlet through which the magnetic body is received. The magnetic body enters into the cup-like portion 45 via the inlet and then, the lid 46 is placed on the cup-like portion 45 to close the inlet. In such a way, the entirety of the magnetic body is encapsulated by the cup-like portion 45 and the lid 46.

The cup-like portion 45 and the lid 46 may be mechanically coupled e.g. through mating or press-fitting. Accordingly, the encapsulating member can maintain its closed state despite the pressure from the fluid flowing into a mold-cavity during injection-molding. In the illustrated case of FIG. 3, an annular protrusion is formed on the top surface around the inlet of the cup-like portion 45 (45*m*, 45*n*), and this is press-fitted with an outer circumferential wall of the lid 46 (46*m*, 46*n*) which extends downward. Additionally or alternatively, the cup-like portion 45 (45*m*, 45*n*) and the lid 46 (46*m*, 46*n*) may be secured via adhesive. The encapsulating member may be configured from three or more parts.

The injection-molded portion at least partially covers or surrounds the encapsulating member encapsulating the magnetic body. The injection-molded portion is formed through supplying melted material into a mold-cavity in which the encapsulating member encapsulating the magnetic body has been placed. The encapsulating member hinders the melted material from directly touching the magnetic body so that demagnetization of the magnetic body is avoided or suppressed. The injection-molded portion seals the cup-like portion 45 and the lid 46 (i.e. the first and second members), facilitating strengthened coupling of the two members, not necessarily limited to this though. In other words, the injection-molded portion covers or surrounds the encapsulating member in a manner to seal a boundary between the cup-like portion 45 and the lid 46.

As would be understood from the above descriptions, in the present embodiment, the injection molding allows integration of the magnetic body in the stop part and demagnetization of the magnetic body is avoided or suppressed by the employment of the encapsulating member. Performing the injection molding while avoiding the demagnetization allows integration of the magnetic body in the stop part and minimized possibility of dropping/falling thereof, and thus stop parts for long-term use and with higher durability can be supplied. Note that any type of magnetic body can be used, but neodymium magnet may be employed preferably. The neodymium magnets have a relatively higher magnetic attraction and demagnetization thereof at room temperature is relatively moderate, and thus may be suitable for long-term use.

The magnetic body may be embedded in one or both of the left and right stop parts. In a case where the magnetic body is embedded in the respective ones of the left and right stop parts as in the illustrated case, the left-side stop part and the right-side stop part will be attracted and both will be stacked. Optionally, additionally to this, rotation of the right-side stop part relative to the left-side stop part may be caused, or rotation of the left-side stop part relative to the right-side stop part may be caused. The rotation of the right-side stop part relative to the left-side stop part may allow insertion of an insertion portion of the right-side stop part into a slider held by the left-side stop part. One may understand a case similarly where the left-side stop part rotates relative to the right-side stop part. This may allow simplified operation required for closing the slide fastener. Slide fasteners can be supplied which are friendly for infants and care-receivers who find difficulty in opening and closing slide fasteners.

The encapsulating member may have an exposed surface that is exposed from the injection-molded portion. In the illustrated case, the exposed surface of the encapsulating member 40*n* includes side and bottom faces of the cup-like portion 45 which are not covered by the injection-molded portion 50*n*. The exposed surface of the encapsulating member 40*m* includes a top face of the lid 46 which is not covered by the injection-molded portion 50*m*. The bottom face of the cup-like portion 45 of the encapsulating member 40*n* and the top face of the lid 46 of the encapsulating member 40*m* are opposed or contacting faces when the magnetic bodies 30*m*, 30*n* are associated by magnetic attraction. As the encapsulating member has the exposed surface exposed from the injection-molded portion, the encapsulating member 40*n* (the cup-like portion 45*n*) is placed directly above the encapsulating member 40*m* (the lid 46*m*) when the left-side stop part 5*n* is stacked onto the right-side stop part 5*m* as shown in FIG. 3. The injection-molded portions 50*m* and 50*n* are not provided between the magnetic body 30*m* and the magnetic body 30*n*, thus facilitating strengthened magnetic attraction between the magnetic bodies 30*m* and 30*n*.

Although not necessarily limited to this, the injection-molded portion may be shaped to hinder the encapsulating member from being separated (dropping) from the injection-molded portion and in other words, the injection-molded portion may have an undercut that hinders the encapsulating member from being separated from the injection-molded portion. As shown in FIG. 3, in the right-side stop part 5*m*, the injection-molded portion 50*m* has: an outer peripheral portion 50*m*1 arranged circumferentially around the encapsulating member 40*m*; a foundation portion 50*m*2 that extends radially inward from the bottom end of the outer peripheral portion 50*m*1 to cover at least partially the bottom face of the encapsulating member 40*m*; and an undercut 50*m*3 that extends radially inward from the outer peripheral portion 50*m*1 at a position above the encapsulating member 40*m*. The encapsulating member 40*m* is sandwiched between the foundation portion 50*m*2 and the undercut 50*m*3, preventing the encapsulating member 40*m* from being separated from the injection-molded portion 50*m*. The boundary between the cup-like portion 45 and the lid 46 may be sealed by the outer peripheral portion 50*m*1. In the illustrated case of FIG. 3, the cup-like portion 45 is positioned at lower side and the lid 46 is positioned at upper side, and thus the undercut 50*m*3 touches the lid 46. Embodiments are envisaged where the cup-like portion 45 is positioned at upper side and the lid 46 is positioned at lower side, and the undercut 50*m*3 touches the cup-like portion 45.

In the left-side stop part 5*n*, the injection-molded portion 50*n* has: an outer peripheral portion 50*n*1 arranged circumferentially around the encapsulating member 40*n*; a foundation portion 50*n*2 that extends radially inward from a top end of the outer peripheral portion 50*n*1 to at least partially cover the top face of the encapsulating member 40*n*; and an undercut 50*n*3 that extends radially inward from the outer peripheral portion 50*n*1 of the encapsulating member 40*n*. The cup-like portion 45*f* has a diameter that decreases downward, and the inner circumference face of the undercut 50*n*3 of the injection-molded portion 50*n* has a diameter that increases upward. Owing to this, the encapsulating member 40*n* is prevented from being separated from the injection-molded portion 50*n*. The boundary between the cup-like portion 45 and the lid 46 may be sealed by the outer peripheral portion 50*n*1. In the illustrated case of FIG. 3, the cup-like portion 45 is positioned under the lid 46 and the undercut 50*n*3 touches the cup-like portion 45. However, embodiments are envisaged where the cup-like portion 45 is positioned above the lid 46, and the undercut 50*n*3 touches the lid 46.

The injection-molded portion may be shaped such that, alone or together with the encapsulating member, various functions are embodied in the stop part. In a non-limiting example, the stop part is configured to allow the right-side stop part to rotate relative to the left-side stop part or to allow the left-side stop part to rotate to the right-side stop part. The left and right stop parts 5*n* and 5*m* each have a base 51*n*,51*m* including the encapsulating member 40*n*,40*m*; and an extending portion 52*n*,52*m* that extends frontward from the base 51*n*,51*m* so as to have an insertion portion 53*m*,53*n* that is to be inserted into the slider 90.

The extending portion 52*n* of the left-side stop part 5*n* has insertion portion 53*n* and guiding bar 54*n* which extend frontward from the base 51*n*. The insertion portion 53*n* is inserted into the slider 90 via the rear mouth 98 of the slider 90. The insertion portion 53*n* is inserted into the slider 90, and the slider 90 is held by the insertion portion 53*n*. Left-side flange 94 of the top or bottom wing 91 or 92 enters into a gap between the insertion portion 53*n* and the guiding bar 54*n*. Left-side fastener tape 4*n* may be exposed between the insertion portion 53*n* and the guiding bar 54*n*, or a region between the insertion portion 53*n* and the guiding bar 54*n* is covered by a thin layer of injection-molded portion. The insertion portion 53*n* of the extending portion 52*n* is configured to receive the insertion portion 53*m* of right-side stop part 5*m* when the slide fastener 1 is closed.

The extending portion 52*m* of the right-side stop part 5*m* has insertion portion 53*m* and stopping bar 54*m* which extend frontward from the base 51*m*. Dummy element 55 sits at the front end of the extending portion 52*m* adjacent to the right-side fastener element 3*m*. The insertion portion 53*m* is inserted into the slider 90 via a slit between right-side upper and lower flanges 94 of the slider 90. The stopping bar 54*m* abuts against the flange 94 of the slider 90, thus defining a stop position for the insertion portion 53*m* pivoting towards the coupling pillar of the slider 90. The slider 90 moves frontward after the insertion portion 53*m* is inserted into the slider 90 so that the insertion portion 53*n* receives the insertion portion 53*m* and the left and right stop parts 5*m* and 5*n* are coupled. Note that, at this instance, hooks 81*m*, 81*n* of the left and right stop parts 5*m*, 5*n* may be engaged.

In the base 51*n* of the left-side stop part 5*n*, the encapsulating member 40*n* protrudes downward from the outer peripheral portion 50*n*1. The magnetic body 30*n* in the encapsulating member 40*n* has a thickness in the up-down direction greater than the thickness of the magnetic body 30*m*, and thus can form the magnetic field farther along the axis AX2 shown in FIG. 4. In contrast, the magnetic body 30*m* in the encapsulating member 40*m* has a width (i.e. radius) in a direction orthogonal to the up-down direction which is greater than the width (i.e. radius) of the magnetic body 30*n*, and thus can form the magnetic field farther along the radial direction directed radially outward from the axis AX1 shown in FIG. 4.

Figure 8:
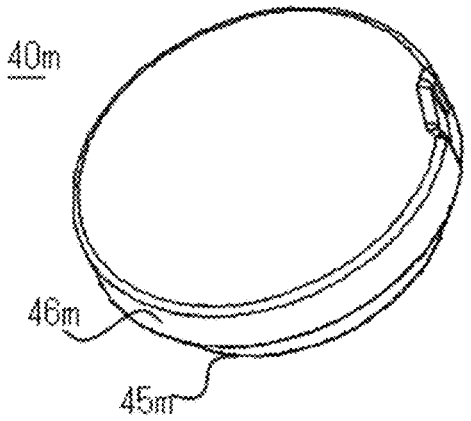
FIG. 8 is a schematic perspective view of an encapsulating member of right-side stop part of an aspect of the present disclosure.
Figure 9:
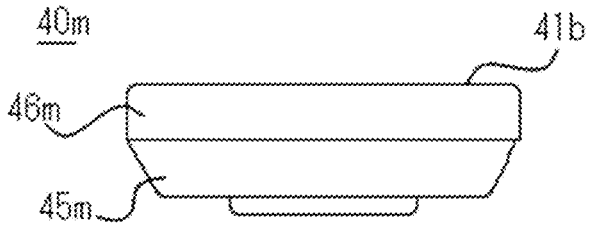
FIG. 9 is a schematic side elevation of an encapsulating member of right-side stop part of an aspect of the present disclosure.
Figure 10:
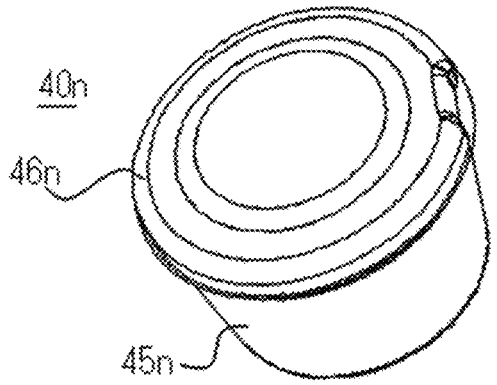
FIG. 10 is a schematic perspective view of an encapsulating member of left-side stop part of an aspect of the present disclosure.
Figure 11:
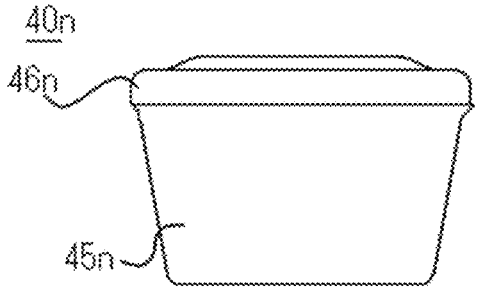
FIG. 11 is a schematic side elevation of an encapsulating member of left-side stop part of an aspect of the present disclosure.

The encapsulating member 40*m* is configured to encapsulate the magnetic body 30*m* having a thinner thickness in the up-down direction and in more detail, is configured from a cup-like portion 45*m* and a lid 46*m* as illustrated in FIGS. 3, 8 and 9. The encapsulating member 40*n* is configured to encapsulate the magnetic body 30*n* having a thicker thickness in the up-down direction and in more detail, is configured from a cup-like portion 45*n* and a lid 46*n* as illustrated in FIGS. 3, 10 and 11. The depth and capacity of the cup-like portion 45*n* are greater than the depth and capacity of the cup-like portion 45*m*. In the base 51*n* of the left-side stop part 5*n*, the cup-like portion 45*n* protrudes downward from the outer peripheral portion 50*n*1. It could be said that the encapsulating member 40*n* has a truncated-cone-like portion with its side face partially covered by the injection-molded portion 50*n*. In the base 51*m* of the right-side stop part 5*m*, the top face of the lid 46*m* is exposed and is opposed to the bottom face of the cup-like portion 45*n*. The top face of the lid 46*m* is a flat surface partially covered by the injection-molded portion 50*m*.

Figure 4:
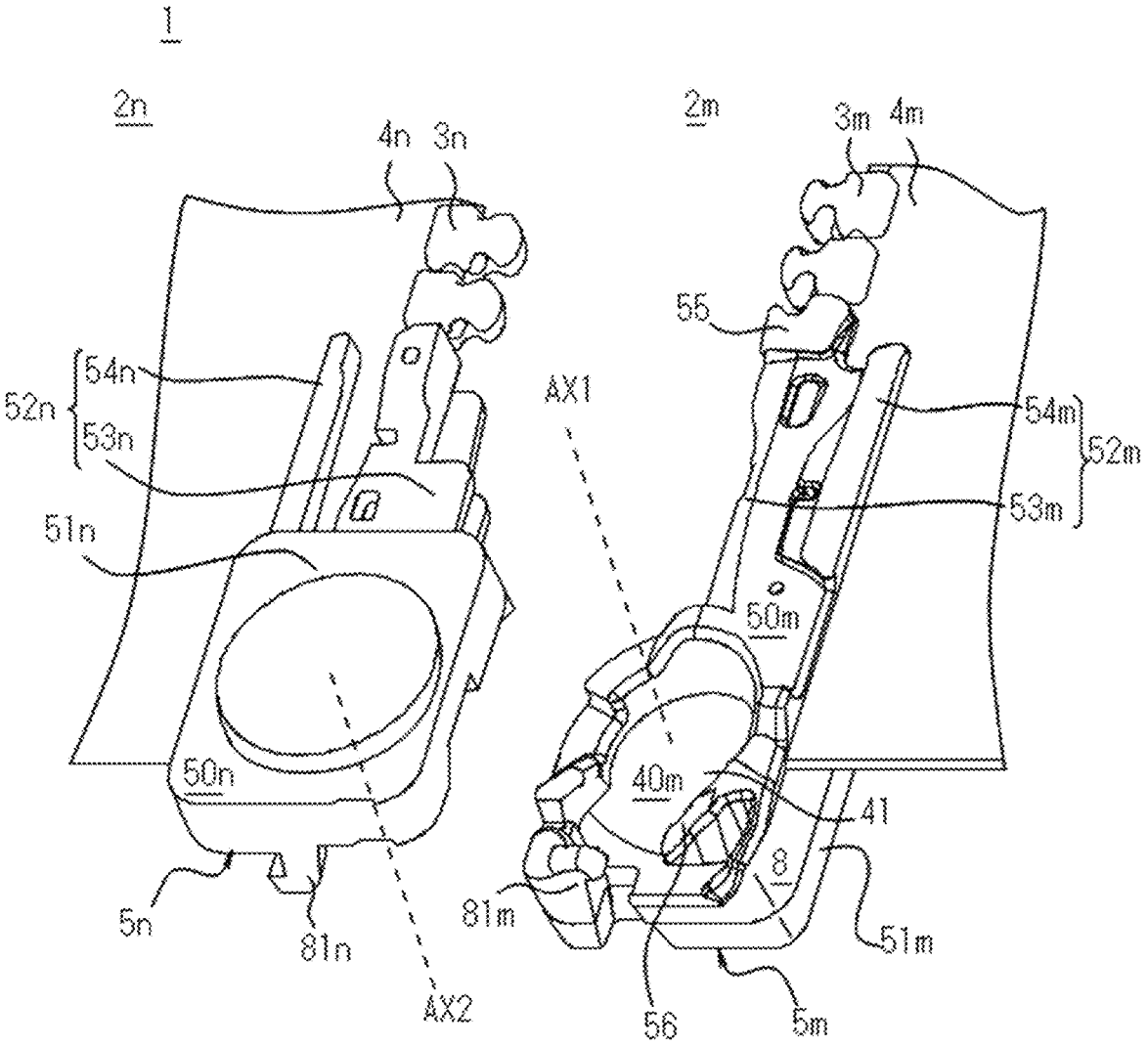
FIG. 4 is a schematic perspective view of rear end of slide fastener in separated condition of an aspect of the present disclosure.

As illustrated in FIGS. 4 and 5, the injection-molded portion 50*m* of the right-side stop part 5*m* is configured to receive the encapsulating member 40*n* of the left-side stop part 5*n*, i.e. the truncated-cone-like portion of the cup-like portion 45. The undercut 50*m*3 extends along the periphery of the encapsulating member 40*m*, thus defining an accommodating space. There is no need for the undercut to be in continuous in the circumferential direction. Embodiments are envisaged where plural undercuts are arranged in the circumferential direction. The injection-molded portion 50*m* has at least one sloped surface 56 that approaches the encapsulating member 40*m* (the top face of the lid 46) as extending along the circumferential direction about the axis AX1 on which N-pole and S-pole of the magnetic body 30*m* are aligned.

The sloped surface 56 is arranged radially outward from the axis AX1 with respect to the magnetic body 30*m*, i.e. arranged in the outer peripheral portion 50*m*1 and/or the undercut 50*m*3 of the injection-molded portion 50*m*. The sloped surface 56 is formed partially in the circumferential direction, e.g. with a length equal to or within 180° or 150° or 90° of the total angular range 360° about the axis AX1. Therefore, even if the undercut 50*m*3 is thinned due to the sloped surface 56, the undercut 50*m*3 can sufficiently suppress the separation of the encapsulating member 40*m* from the injection-molded portion 50*m*.

Figure 6:
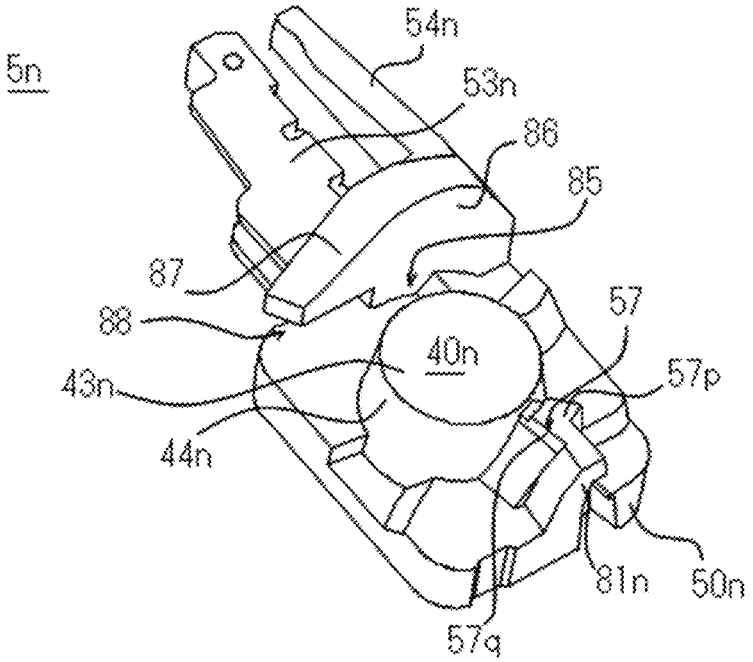
FIG. 6 is a schematic perspective view of a left-side stop part of an aspect of the present disclosure.

As illustrated in FIGS. 6 and 7, the injection-molded portion 50*n* of the left-side stop part 5*n* is configured to have at least one sliding portion 57 that slides on the sloped surface 56 in accordance with magnetic attraction effected between the magnetic bodies 30*m* and 30*n*. The sliding portion 57 is arranged radially outward from the axis AX2 with respect to the magnetic body 30*n*, i.e. arranged radially outward of the truncated-cone-like portion with respect to the axis AX2. The sliding portion 57 is arranged in the outer peripheral portion 50*n*1 and/or the undercut 50*n*3 of the injection-molded portion 50*n*. The sliding portion 57 is an edge between a flat surface 57*p* and a vertical surface 57*q* but should not be limited to this.

Figure 12:
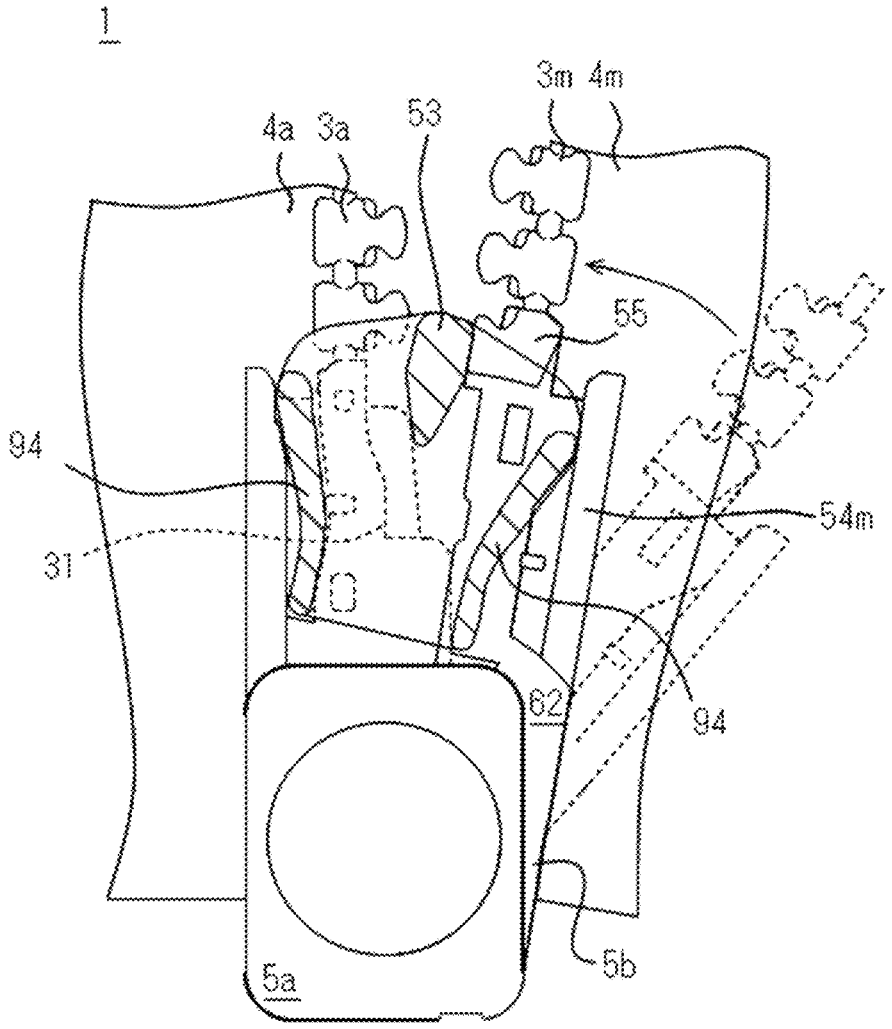
FIG. 12 is a schematic illustration illustrating that, in a slide fastener of an aspect of the present disclosure, an insertion portion of right-side stop part is automatically inserted into a slider in accordance with magnetic attraction effected between magnetic bodies of left-side and right-side stop parts.

When the left and right stop parts 5*m* and 5*n* are stacked in accordance with the magnetic attraction effected between the magnetic bodies 30*m* and 30*n*, the sliding portion 57 touches the sloped surface 56 and descends the sloped surface 56. In this process, as illustrated in FIG. 12, the right-side stop part 5*m* rotates relative to the left-side stop part 5*n*, and the insertion portion 53*m* of the right-side stop part 5*m* is inserted into the slider 90 via the slit between the right-side upper and lower flanges 94 of the slider 90. Embodiments are envisaged where, during a period the sliding portion 57 descends the sloped surface 56, the number of contact points between the bases 51*m* and 51*n* increases and rotational stability is enhanced.

Note that, as illustrated in FIGS. 6 and 7, the injection-molded portion 50*n* of the left-side stop part 5*n* includes a wall 86 arranged to form a groove 85 between the wall 86 and the encapsulating member 40*n* (i.e. the truncated-cone-like portion of the cup-like portion 45). The wall 86 has a descending sloped surface 87 that descends in the circumferential direction with respect to the axis AX2. The downstream end of the descending sloped surface 87 protrudes in the left-right direction than the rear end of the slider 90. A slot 88 is formed between the wall 86 and the outer peripheral portion 50*n*1. The slot 88 is in spatial communication with the accommodating space of the insertion portion 53*n* of the left-side stop part 5*n*. When the insertion portion 53*m* of the right-side stop part 5*m* is placed on the descending sloped surface 87, the insertion portion 53*m* descends the descending sloped surface 87 in accordance with the magnetic attraction effected between the magnetic bodies 30*m* and 30*n*, and then is inserted into the inside of the slider 90 and the slot 88 without significantly interfering with the slider 90.

Figure 13:
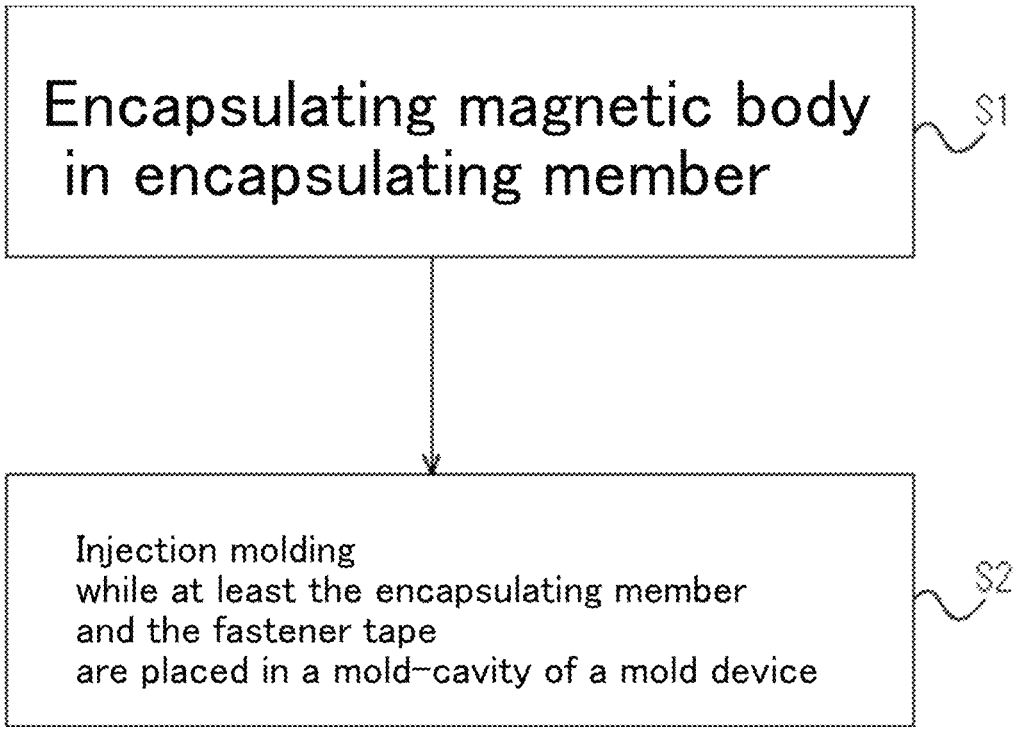
FIG. 13 is a flowchart of steps for producing a fastener stringer of an aspect of the present disclosure.
Figure 14:
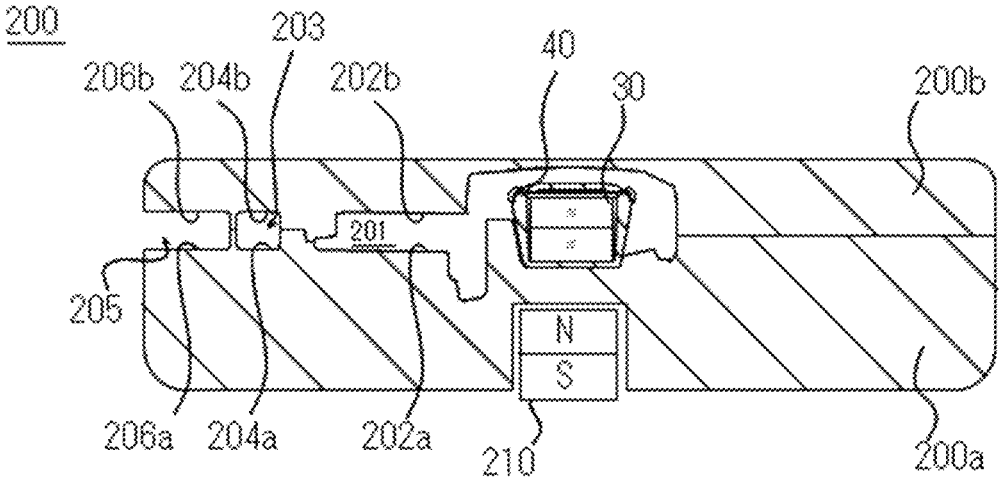
FIG. 14 is a schematic illustration of production process of fastener stringer of an aspect of the present disclosure.

Non-limiting methods of producing the above-described fastener stringers will be described with reference to FIGS. 13 and 14. Firstly, the magnetic body is encapsulated in the encapsulating member (S1). The encapsulating member can be produced through injection-molding in advance. In more detail, the magnetic body is placed inside of the cup-like portion, and then the inlet of the cup-like portion is closed by the lid. Note that, encapsulating the magnetic body in the encapsulating member can be performed by human or robot or corporation of the both. The operation of encapsulating the magnetic body in the encapsulating member can be performed at any location, but can be performed on a mold device described below, e.g. a fixed mold.

Next, injection molding is performed while at least the encapsulating member and the fastener tape are placed in a mold-cavity of a mold device (S2). As illustrated in FIG. 14, the mold device may have a fixed mold 200*a* and a movable mold 200*b*. The fixed mold 200*a* and the movable mold 200*b* have cavity-surfaces 202*a* and 202*b* which form the mold-cavity 201. The encapsulating member can be placed at a predetermined location on the cavity surface 202*a* of the fixed mold 200*a* while the movable mold 200*b* is positioned away from the fixed mold 200*a*. For a purpose of appropriate alignment of the encapsulating member 40 on the fixed mold 200*a*, the fixed mold 200*a* may be provided with a magnet 210 for alignment. The magnetic body 30 inside the encapsulating member 40 is attracted by the magnet 210 for alignment so that appropriate alignment is ensured. Note that, in the fixed mold 200*a* and the movable mold 200*b*, surfaces 204*a*, 204*b*, 206*a* and 206*b* are formed which define the accommodating spaces 203 and 205 for accommodating the fastener elements.

The melted material, e.g. melted resin to be supplied into the mold-cavity 201 of the mold device may be supplied into the mold-cavity 201 through a sprue, a runner and a gate not illustrated. The melted resin, having been supplied into the mold-cavity 201, reaches and touches the encapsulating member 40, but does not directly touch the magnetic body as being hindered by the encapsulating member 40 so that demagnetization of the magnetic body is avoided or suppressed. Once the mold-cavity 201 is filled with the melted resin, the mold device 200 is cooled and the resin inside the mold-cavity 201 is hardened so that the injection-molded portion is molded. Injection molding for the injection-molded portion 50*m* of the right-side stop part 5*m* should be similarly appreciated.

Figure 15:
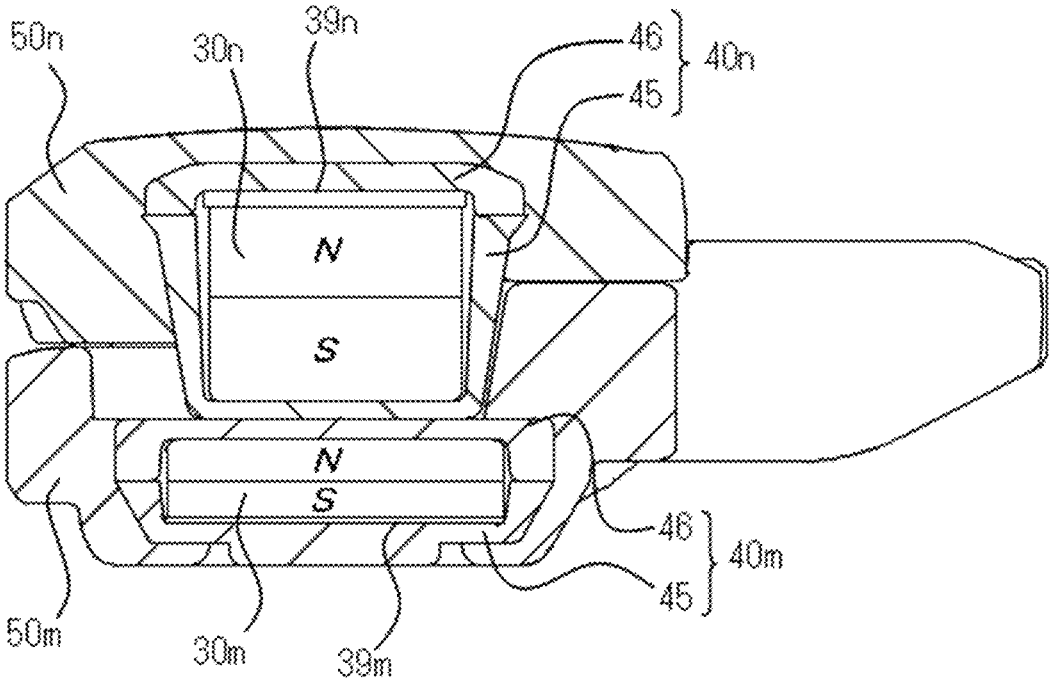
FIG. 15 is a schematic cross-sectional view of an embodiment where a cup-like portion and a lid are not mated.
Figure 16:
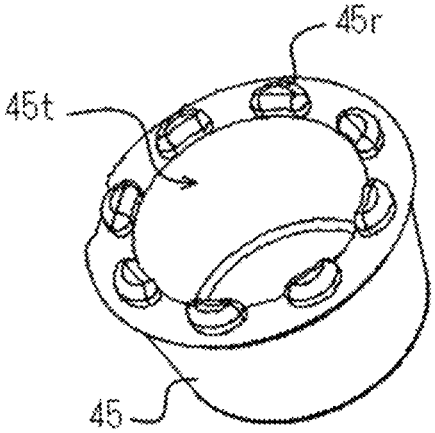
FIG. 16 is a schematic perspective view of a variant cup-like portion included in an encapsulating member.
Figure 17:
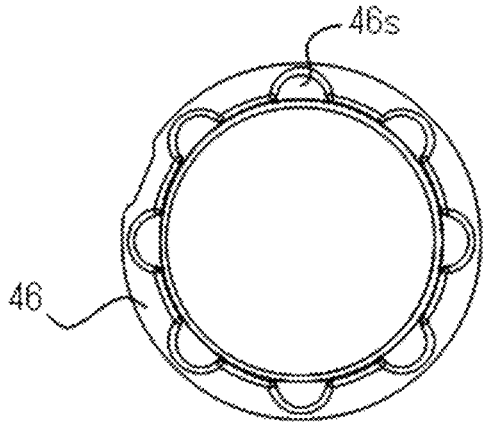
FIG. 17 is a schematic perspective view showing a variant lid in encapsulating member.
Figure 18:
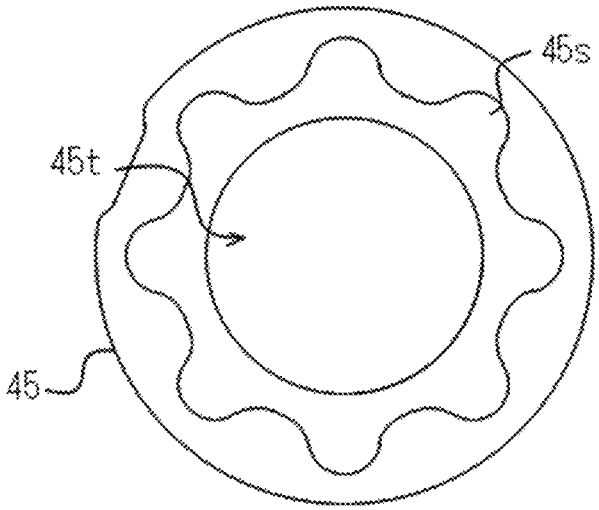
FIG. 18 is a schematic perspective view showing a variant of a cup-like portion in encapsulating member.
Figure 19:
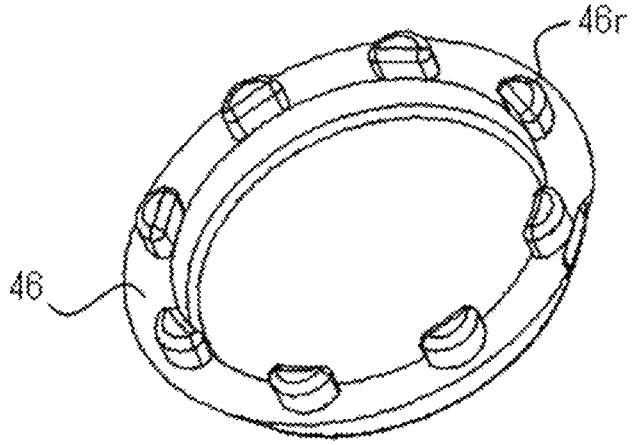
FIG. 19 is a schematic perspective view showing a variant lid in encapsulating member.

FIG. 15 discloses an embodiment where the cup-like portion and the lid are not mated. Embodiments are envisaged where the lid is placed onto the top face positioned circumferentially around the inlet of the cup-like portion and is fixed thereto via an adhesive. FIG. 16 illustrates an embodiment where the cup-like portion 45 and the lid 46 are mated. The cup-like portion 45 has an inlet 45*t* for receiving the magnetic body, and a plurality of protrusions 45*r* arranged along a periphery of the inlet 45*t*. As shown in FIG. 17, the lid 46 has recesses 46*s* to be mated with the protrusions 45*r* respectively. The number of the protrusion 45*r* and the recess 46*s* should not be limited to 8 as illustrated, but may be equal to or greater than 1, preferably equal to or greater than 2 or 3 or 4. As illustrated in FIG. 18, embodiments are envisaged where one recess 45*s* is provided which is continuous in the circumferential direction of the cup-like portion 45. FIG. 19 illustrates a lid 46 with a plurality of protrusions 46*r* to be mated with the recess 45*s* of FIG. 18.

Figure 20:
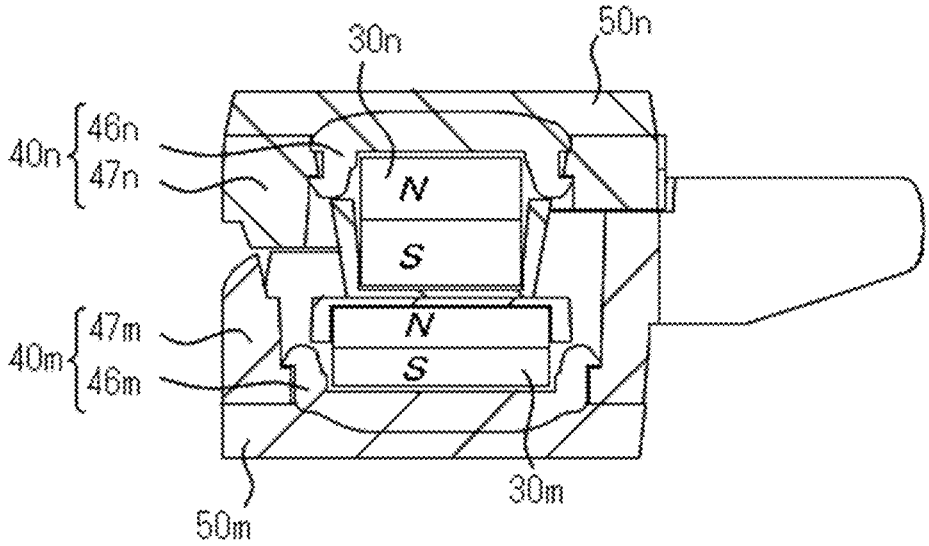
FIG. 20 is a schematic cross-sectional view of a variant where an encapsulating member provides one or more functions (e.g. a sloped surface, a sliding portion, or an insertion portion inserted into a slider) of a stop.

As noted above, the injection-molded portion may be shaped such that, alone or together with the encapsulating member, various functions are embodied in the stop part. Functions to be allocated to the injection-molded portion and to be allocated to the encapsulating member would be determined in view of specific requirements (customer demand, efficiency of manufacturing, ease of design). Therefore, embodiments are envisaged as a matter of course where the above-described sloped surface 56 or the sliding portion 57 is formed in the encapsulating member instead of the injection-molded portion. FIG. 20 clarifies this point and shows a variant where the encapsulating member provides one or more functions of the stop part (e.g. the sloped surface, the sliding portion, the insertion portion to be inserted into the slider). In the right-side stop part 5*m*, the injection-molded portion 50*m* is formed below the encapsulating member 40*m*. In the left-side stop part 5*n*, the injection-molded portion 50*n* is formed above the encapsulating member 40*n*.

The encapsulating member 40*m* has a recess for accommodating the magnetic body 30*m*; the sloped surface 56 (optional); a main body 47*m* provided with the insertion portion (optional); and a lid 46*m* coupled to the main body 47*m* for confining the magnetic body 30*m* in the recess. Embodiments are envisaged where the main body 47*m* is fixed to the fastener tape in advance before forming the injection-molded portion 50*m*, but should not be limited to this. Similarly, the encapsulating member 40*n* has a recess for accommodating the magnetic body 30*n*; a sliding portion 57 (optional); a main body 47*n* provided with the insertion portion (optional); and a lid 46*n* coupled to the main body 47*n* for confining the magnetic body 30*n* in the recess. Embodiments are envisaged where the main body 47*n* is fixed to the fastener tape in advance before forming the injection-molded portion 50*n*, but should not be limited to this.

A skilled person in the art would be able to add various modifications to the respective embodiments based on the above teachings. Reference codes in claims are added just for a purpose of reference and should not be referred to for narrowly construing the scope of claim.

LIST OF REFERENCE NUMERALS

1: Slide fastener

2*m*, 2*n*: Fastener stringer

3*m*, 3*n*: Fastener element

4*m*, 4*n*: Right-side fastener tape

90: Slider

5*m*, 5*n*: Stop part

30*m*, 30*n*: Magnetic body

40*m*, 40*n*: Encapsulating member

46*m*, 46*n*: Lid

50*m*, 50*n*: Injection-molded portion

200: Mold

The invention claimed is:

1. A fastener stringer comprising:
a fastener tape provided with a fastener element; and
a stop part arranged at an end of the fastener tape, wherein the stop part includes:
a magnetic body;
an encapsulating member encapsulating the magnetic body; and
an injection-molded portion that at least partially covers or surrounds the encapsulating member encapsulating the magnetic body, and wherein
at least the encapsulating member hinders heat from being transferred to the magnetic body while the injection-molded portion is formed.

2. The fastener stringer of claim 1, wherein a heat-insulating layer is formed between the encapsulating member and the magnetic body.

3. The fastener stringer of claim 1, wherein the encapsulating member has an exposed surface that is exposed from the injection-molded portion.

4. The fastener stringer of claim 1, wherein the injection-molded portion is shaped to hinder the encapsulating member from being separated from the injection-molded portion.

5. The fastener stringer of claim 1, wherein the injection-molded portion comprises an outer peripheral portion arranged circumferentially around the encapsulating member and an undercut extending or protruding radially inward from the outer peripheral portion.

6. The fastener stringer of claim 1, wherein the encapsulating member includes at least first and second members, a boundary between the first and second members being sealed by the injection-molded portion.

7. The fastener stringer of claim 6, wherein one of the first and second members is a cup-like portion having an inlet through which the magnetic body is received, and the other one of the first and second members is a lid that closes the inlet of the cup-like portion.

8. The fastener stringer of claim 6, wherein one of the first and second members comprises an inlet through which the magnetic body is received and one or more protrusions arranged along a periphery of the inlet, and the other one of the first and second members comprises one or more recesses mated with the one or more protrusions.

9. The fastener stringer of claim 1, wherein the encapsulating member comprises (i) a truncated-cone-like portion having a side face partially covered by the injection-molded portion or (ii) a flat surface partially covered by the injection-molded portion.

10. The fastener stringer of claim 1, wherein the injection-molded portion comprises:
a base including the encapsulating member; and
an extending portion extending from the base so as to have an insertion portion that is to be inserted into a slider.

11. The fastener stringer of claim 10, wherein the base comprises at least one sloped surface that approaches the encapsulating member as extending along a circumferential direction about an axis on which N-pole and S-pole of the magnetic body are aligned, the sloped surface being positioned over the encapsulating member at least partially.

12. The fastener stringer of claim 10, wherein the encapsulating member includes a truncated-cone-like portion with its side face partially covered by the injection-molded portion and the base comprises at least one sliding portion arranged radially outward of the truncated-cone-like portion with respect to an axis on which N-pole and S-pole of the magnetic body are aligned.

13. The fastener stringer of claim 1, wherein the magnetic body is a neodymium magnet.

14. A slide fastener comprising:

first and second fastener stringers, the first fastener stringer including a first fastener tape provided with a first fastener element, and a first stop part provided at an end of the first fastener tape, and the second fastener stringer including a second fastener tape provided with a second fastener element and a second stop part provided at an end of the second fastener tape and adapted to configure a stop together with the first stop part; and a slider adapted for engaging and disengaging the first and second fastener stringers, wherein the first stop part includes a first magnetic body, a first encapsulating member encapsulating the first magnetic body, a first injection-molded portion that at least partially covers or surrounds the first encapsulating member encapsulating the first magnetic body, and at least one sloped surface that approaches the first encapsulating member as extending along a circumferential direction about an axis on which N-pole and S-pole of the first magnetic body are aligned, and wherein the second stop part includes a second magnetic body a second encapsulating member encapsulating the second magnetic body, a second injection-molded portion that at least partially covers or surrounds the second encapsulating member encapsulating the second magnetic body and at least one sliding portion that slides on the sloped surface in accordance with magnetic attraction effected between the first and second magnetic bodies.

15. The slide fastener of claim 14, wherein the first encapsulating member has a flat surface partially covered by the injection-molded portion, and the sloped surface is at least partially formed over the flat surface, the second encapsulating member has a truncated-cone-like portion with its side face partially covered by the injection-molded portion, and the sliding portion is arranged radially outward of the truncated-cone-like portion with respect to an axis along which N-pole and S-pole of the second magnetic body are aligned.

16. The slide fastener of claim 14, wherein at least one of the first and second encapsulating members includes a cup-like portion having an inlet through which the magnetic body is received, and a lid that closes the inlet of the cup-like portion.

17. A method of producing a fastener stringer that comprises a fastener tape provided with a fastener element, and a stop part arranged at an end of the fastener tape, the method comprising:

encapsulating a magnetic body in an encapsulating member; and performing injection-molding in a condition where the encapsulating member, by which the magnetic body is encapsulated, and a portion of the fastener tape are arranged in a mold-cavity of a mold, wherein at least the encapsulating member hinders heat from being transferred to the magnetic body during the injection molding.

* * * * *